US005636389A

United States Patent [19]

LaLonde

[11] Patent Number: 5,636,389

[45] Date of Patent: Jun. 10, 1997

[54] TOILET SEAT LID WITH REMOVABLE, CUSTOMIZABLE INSERT

[76] Inventor: Lawrence S. LaLonde, 16156 Tana Tea Cir., Tega Cay, S.C. 29715

[21] Appl. No.: 565,227

[22] Filed: Nov. 30, 1995

[51] Int. Cl.[6] ..... A47K 13/00; A47K 13/24

[52] U.S. Cl. ..... 4/242.1; 4/661; D23/311

[58] Field of Search ..... 4/242.1, 234, 661, 4/902, DIG. 18; D23/311, 312

[56] References Cited

U.S. PATENT DOCUMENTS

| | | | |
|---|---|---|---|
| D. 238,673 | 2/1976 | Stairs | D23/312 |
| 2,047,480 | 7/1936 | MacDonald | 4/234 |
| 3,484,876 | 12/1969 | Thomas | 4/234 |
| 4,309,782 | 1/1982 | Paulin | 4/661 |
| 4,368,551 | 1/1983 | Cummings | 4/661 |
| 4,744,113 | 5/1988 | Kogut | 4/661 |
| 5,022,946 | 6/1991 | Stewart | 156/272.4 |
| 5,086,521 | 2/1992 | Stewart | 4/234 |
| 5,182,823 | 2/1993 | Alsip | 4/234 |
| 5,426,793 | 6/1995 | Mac | 4/237 |

FOREIGN PATENT DOCUMENTS

| | | | |
|---|---|---|---|
| 2681232 | 3/1993 | France | 4/234 |

OTHER PUBLICATIONS

"What's New in Products & Displays," Hardware Age, p. 127.

*Primary Examiner*—Henry J. Recla
*Assistant Examiner*—Charles R. Eloshway
*Attorney, Agent, or Firm*—Adams Law Firm, P.A.

[57] ABSTRACT

A toilet seat lid with a removably attached center portion allowing for custom enhancement is disclosed. The lid is comprised of an annulus, the center of which is a removable insert coverable by material bearing a design. Whenever desired, the insert may be removed from the annulus so that the existing material can be replaced by a new material. The insert may then be reattached to the annulus.

1 Claim, 17 Drawing Sheets

TOILET SEAT LID WITH REMOVABLE, CUSTOMIZABLE INSERT

BACKGROUND—FIELD OF INVENTION

This invention relates to bathroom fixtures, specifically to the lid covering the seat on a toilet and to an improvement which allows each lid to be individually customized for decorating purposes.

BACKGROUND—DESCRIPTION OF PRIOR ART

Toilet seats and lids have traditionally come in white, although a very limited selection of other colors is available. The lids can also be found with patterns (such as swirls, scallops and seashells) formed into the lid during the manufacturing process. In the case of padded lids, a design may be sewn into or printed onto the cover of the padding during manufacture.

The main disadvantage of these seats and lids is that, for decorating purposes, the decorator or homeowner is limited to the selection of styles and colors offered by the manufacturer. In most newer homes, a great deal of time is spent on the design, layout and decor of the bathrooms. Dozens of sinks, tubs, showers, fixtures, commodes, floor treatments, window treatments and wall treatments are available to customize the room, but the lid color and design must be chosen from a very small offering.

There have been attempts to solve this decorating problem. It is possible to buy lid and tank covers, but the problem with these covers is the same as with the original lids; materials and colors are limited to the product line of the cover manufacturer.

U.S. Pat. No. 3,484,876 reveals a design for decorating a lid by encasing an emblem in plastic in the lid during the manufacturing process. While this design enables the lid to have a different appearance from a standard lid, it is nonetheless limited in scope in the same manner as the swirled or seashell lids mentioned above; the decorator or homeowner is limited to the manufacturer's product line.

U.S. Pat. No. 4,368,551 discloses a structure which is used to enclose the entire toilet in a utility cabinet. Although this design does make the toilet more decorative, it makes no provision for homeowners who would prefer not to enclose the toilet.

OBJECTS AND ADVANTAGES

Accordingly, several objects and advantages of my invention are:

(a) to allow the decorator or homeowner to customize and enhance the appearance of the toilet lid by inserting a piece of material of their choosing into the display area of the lid;

(b) to allow covering materials of various thicknesses used in the decor of the bathroom (wall paper or curtains, for example) to be inserted into the display area of the lid, giving a custom appearance for that individual bathroom;

(c) to allow the material to be easily changed if the decor in the bathroom changes or if the existing material becomes soiled;

(d) to allow the enhanced lid to perform in the same manner as a standard lid with no loss of functionality;

(e) to allow the lid to be easily manufactured using existing materials and technology.

DESCRIPTION OF THE INVENTION

Figure 1:
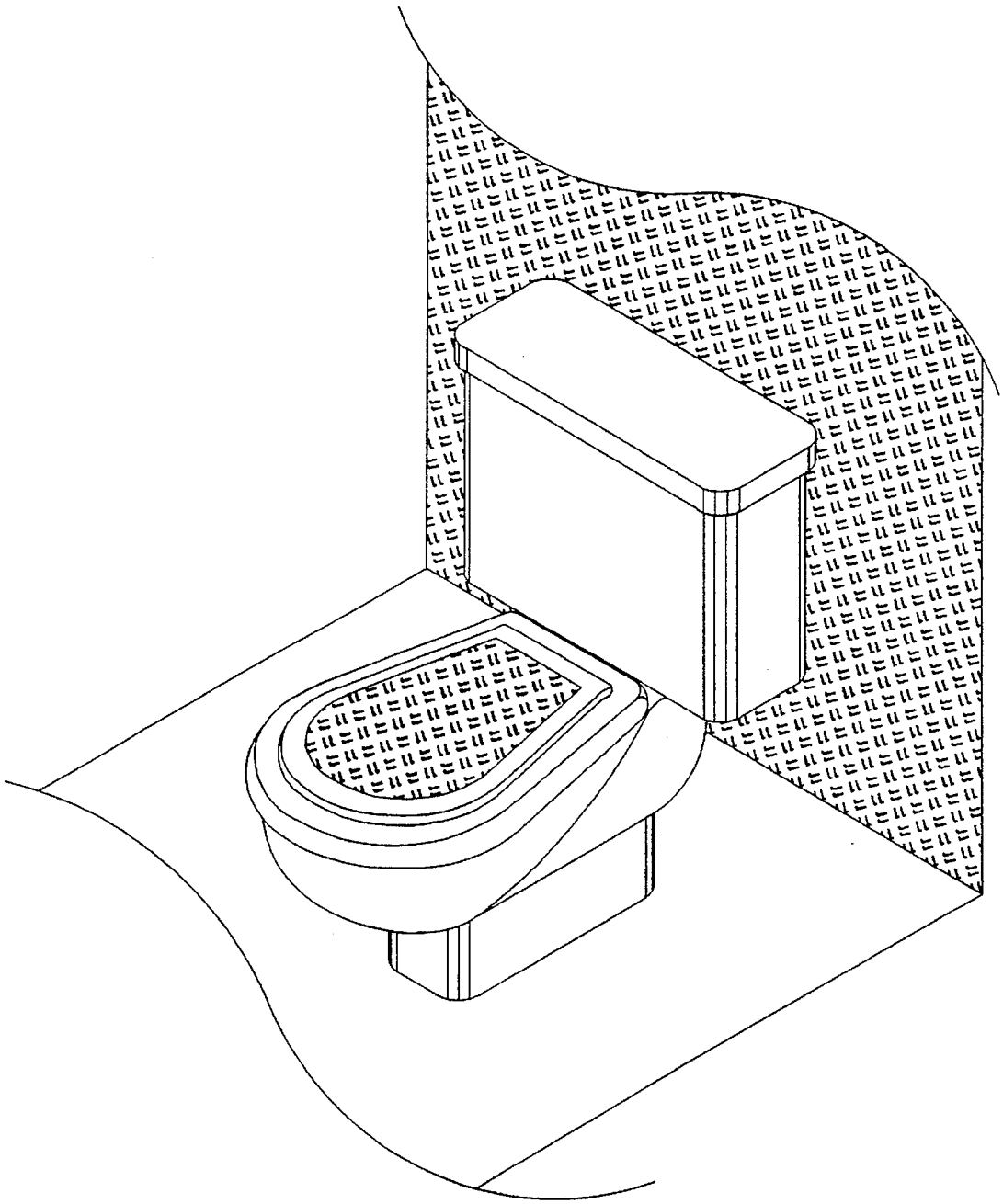
FIG. 1 is a perspective view showing the lid in position on a toilet and the insert covered with a piece of the same wall paper which was used on the wall behind the toilet.
Figure 2:
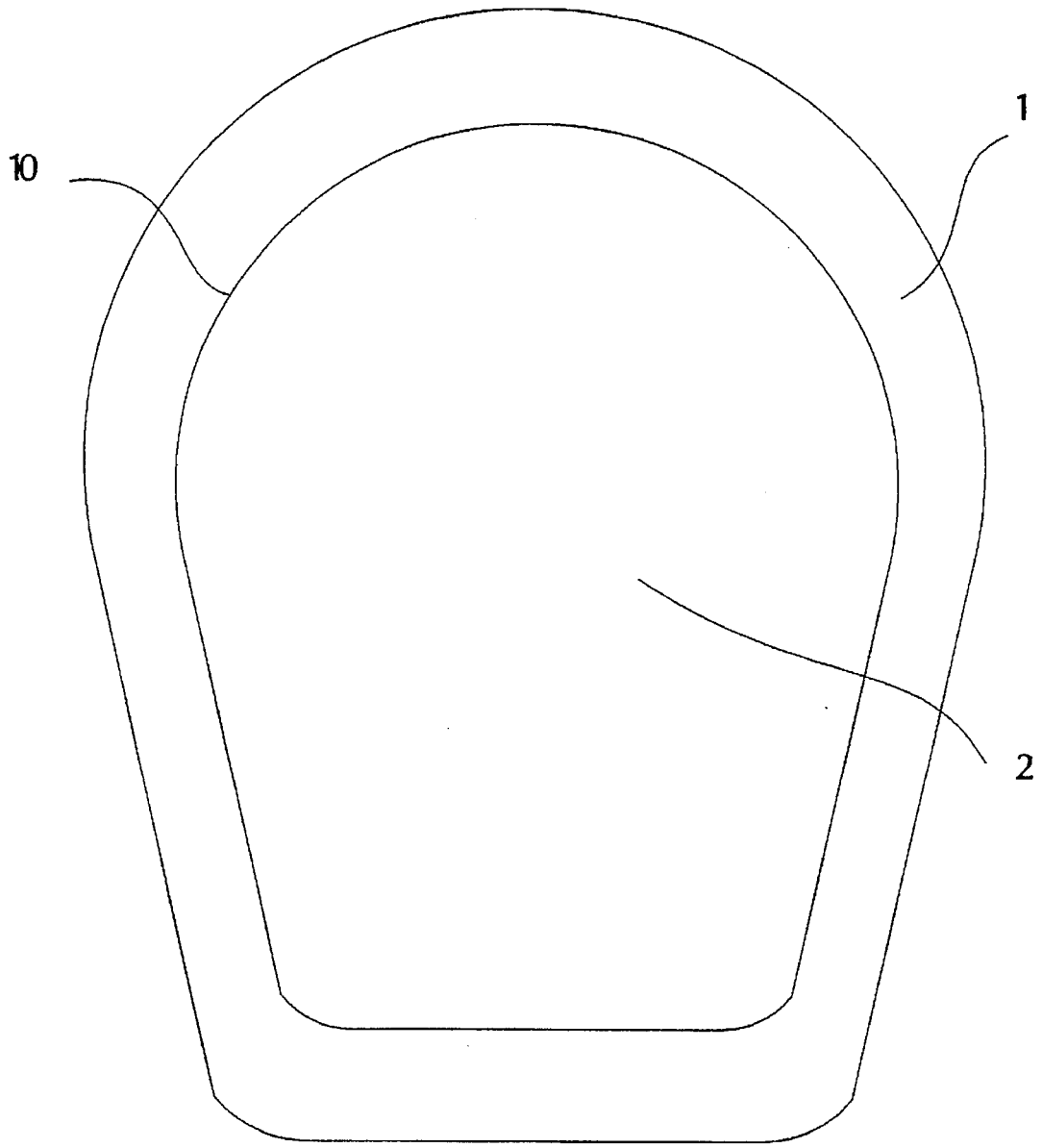
FIG. 2 is a top plan view showing the outer ring and insert in an assembled position before covering the insert with a decorative material.
Figure 3:
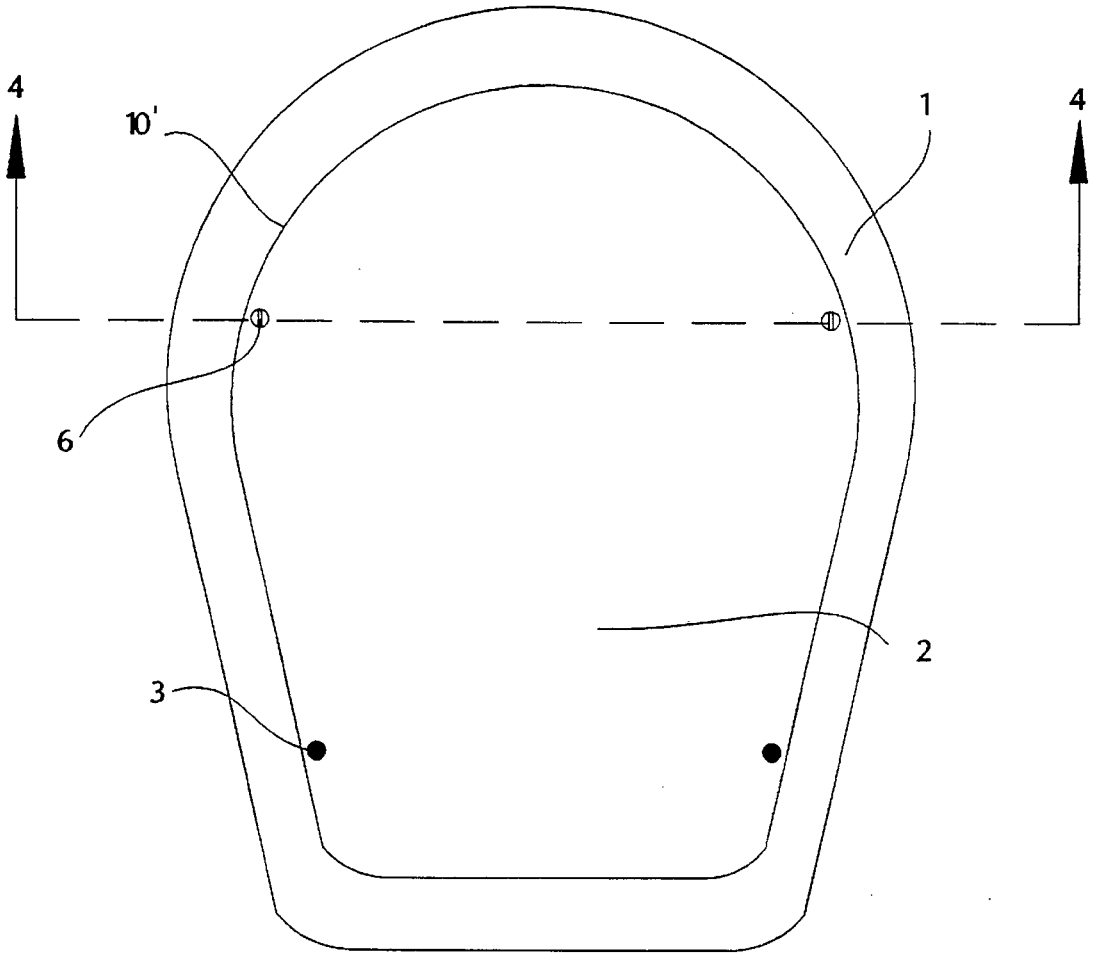
FIG. 3 is a bottom plan view showing the outer ring, insert and a means of attachment in the assembled position.

The present invention is a toilet seat lid which consists of an annulus 1 with a center void and a removable insert 2, best shown in plan view in FIG. 2. The outer shape of the insert 2 is predetermined by the inner shape of the void in the annulus 1. These shapes are represented by element 10 in FIG. 2 and by element 10' in FIG. 3.

The annulus 1 is mounted to the toilet seat using a conventional toilet seat mounting bracket which includes two hinges, one for the seat and one for the lid. The toilet seat and the bracket/hinge assembly are not essential to the description of the present invention and are not shown.

Figure 4:
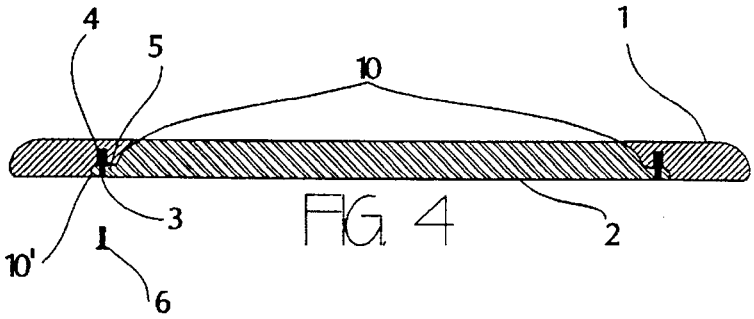
FIG. 4 is a cross sectional view of the outer ring, insert and means of attachment in the assembled position as shown in FIG. 2 and FIG. 3.

The insert 2 is detachably mounted to the annulus 1 using at least one, but preferably several, attachment means located on the annulus 1 and the insert 2. In one embodiment represented in FIG. 4, the attachment means consists of a threaded insert 4 permanently mounted into the annulus 1. A corresponding hole 3 is bored through the flange 5 of the insert 2. The insert 2 is then held in place by inserting a conventional machine screw 6 through the hole 3 in the flange 5 and tightening the machine screw 6 into the threaded insert 4 in annulus 1. The threaded insert 4 and machine screw 6 can be made of virtually any material normally used in the manufacture of such parts, but given the nature of this application, a corrosion resistant material such as brass, nylon or stainless steel would be preferred.

Figure 6:
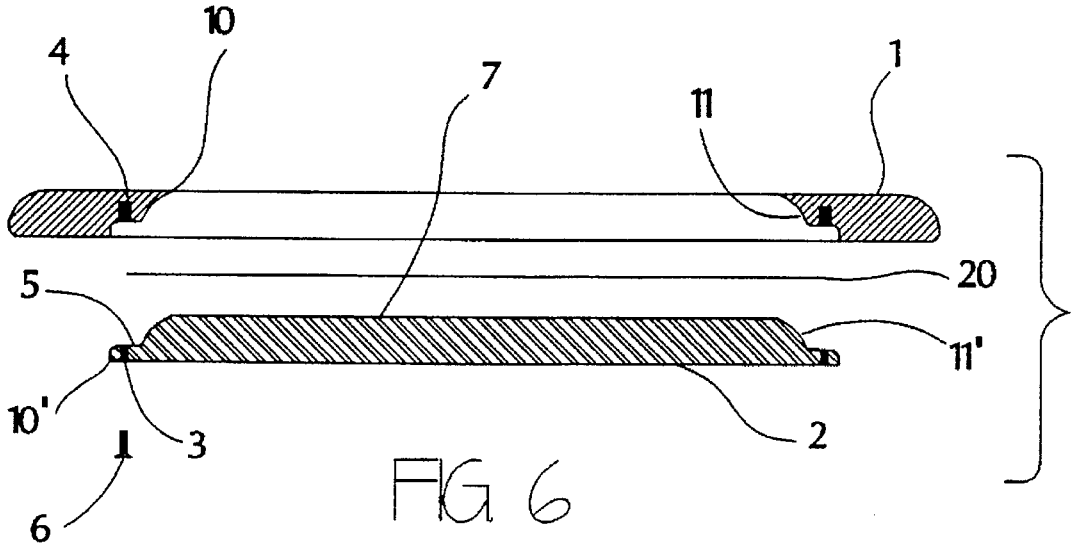
FIG. 6 is a cross sectional view showing the outer ring, insert and decorative material in preparation for assembly.
Figure 7:
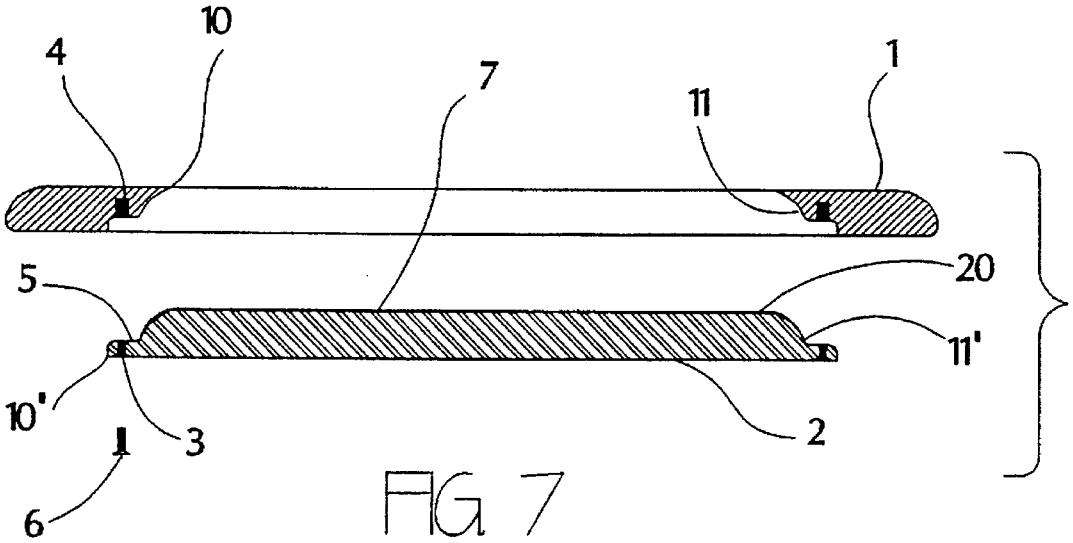
FIG. 7 is a cross sectional view showing the outer ring, insert and decorative material with the decorative material in position on the insert.
Figure 8:
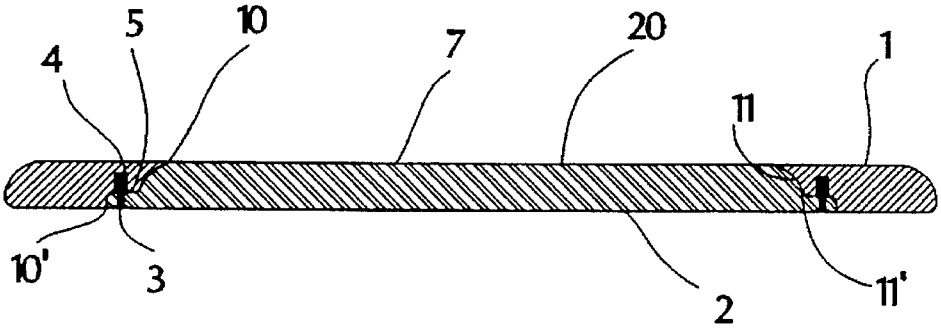
FIG. 8 is a cross sectional view showing the outer ring, insert and decorative material in the assembled position.

The present invention functions as shown in FIGS. 6, 7 and 8. Once the attachment means is released, the insert 2 is free to be removed from the annulus 1. A piece of decorative material 20 is selected and cut to fit over the top face 7 and radiused surface 11' of the insert 2. The cutting of the decorative material 20 can be accomplished by many means, such as using a supplied template, using a previously cut piece of decorative material or using the bottom shape 10' of the insert 2 as a template.

FIGS. 7 & 8 show how the decorative material 20, after being cut, is placed over the top face 7 of the insert 2 in such a manner that the decorative material 20 evenly covers the top face 7 and the radiused surface 11' of the insert 2.

Figure 9:
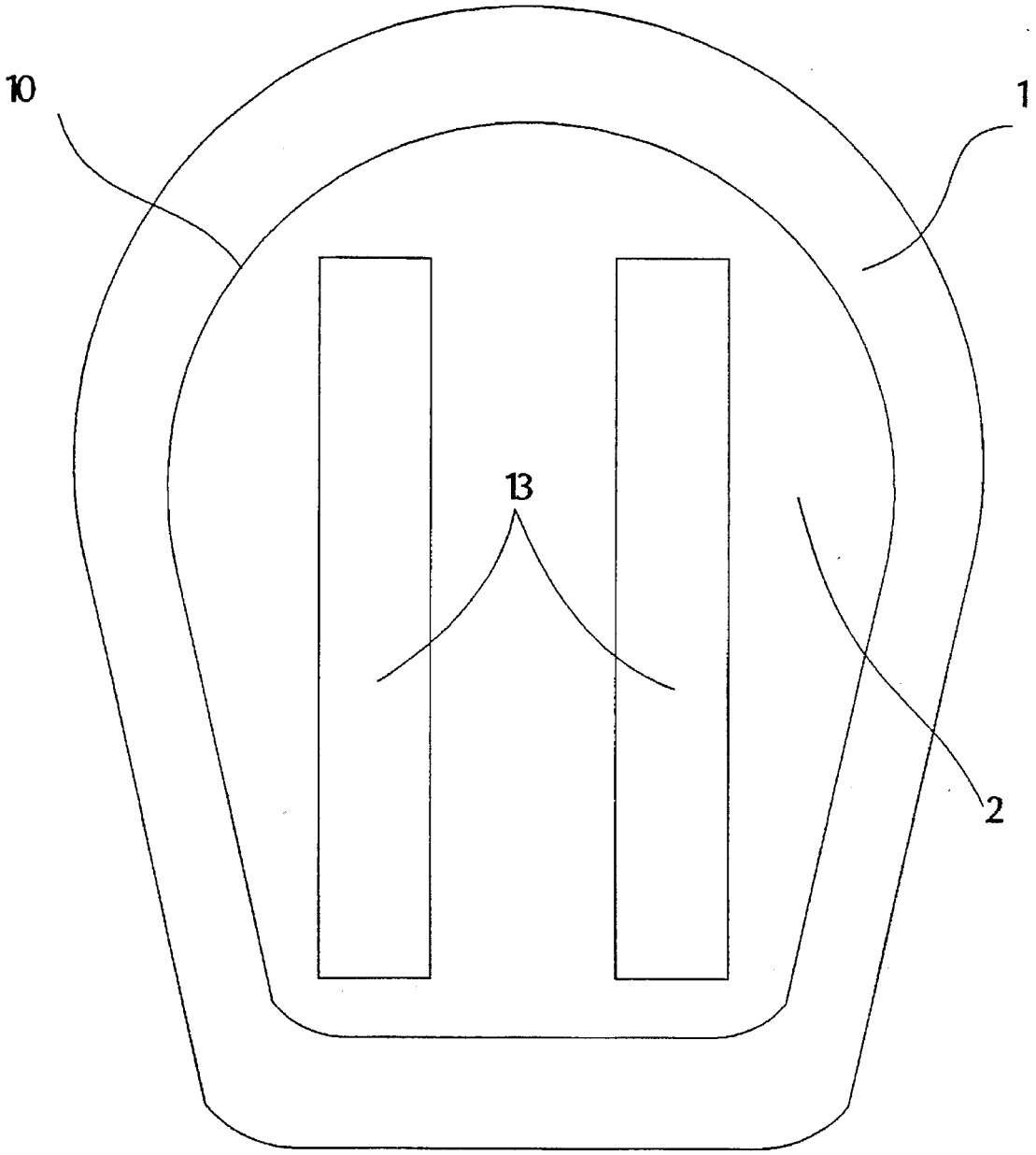
FIG. 9 is a top plan view showing the outer ring and insert in the assembled position with adhesive strips positioned on the insert.

Optionally, adhesive material 13 can be placed onto the top face 7 of the insert 2 to temporarily affix the decorative material 20 to the insert 2 during assembly. Any quantity of adhesive material 13 in virtually any shape can be used, but in this embodiment the adhesive material 13 is applied in two rectangular strips as shown in FIG. 9.

Figure 5:
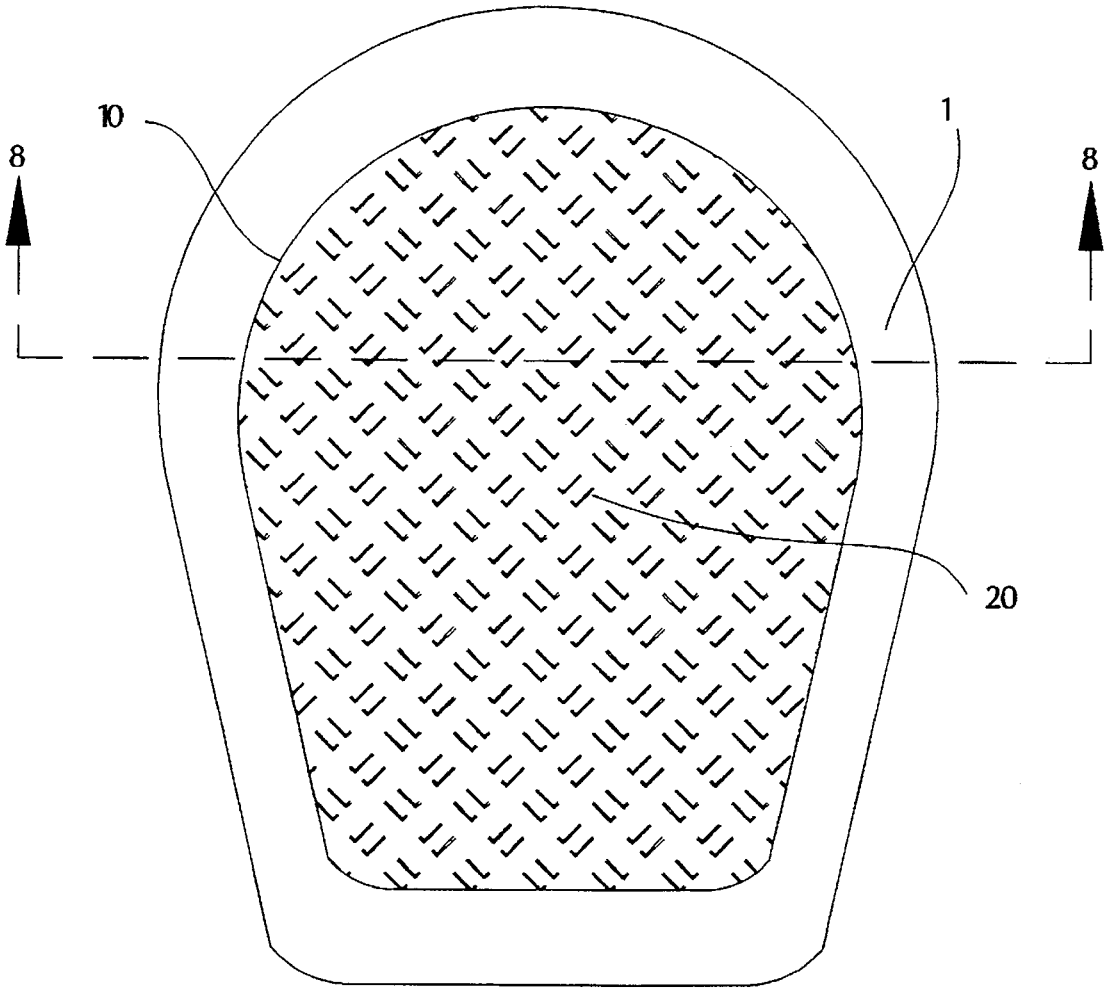
FIG. 5 is a top plan view showing the outer ring and insert with the display area of the insert covered with the same decorative material as FIG. 1.

Once the decorative material 20 is correctly positioned on the insert 2, the insert 2 is detachably mounted to the annulus 1 using the attachment means. The decorative material 20 is sandwiched between the radiused surfaces 11 and 11', providing secure temporary attachment of the decorative material 20 to the toilet seat lid assembly and allowing the decorative material 20 to be viewed through the void in the annulus 1, the shape of the void and the visible portion of the decorative material 20 being defined by element 10 in FIG. 5.

Figure 10:
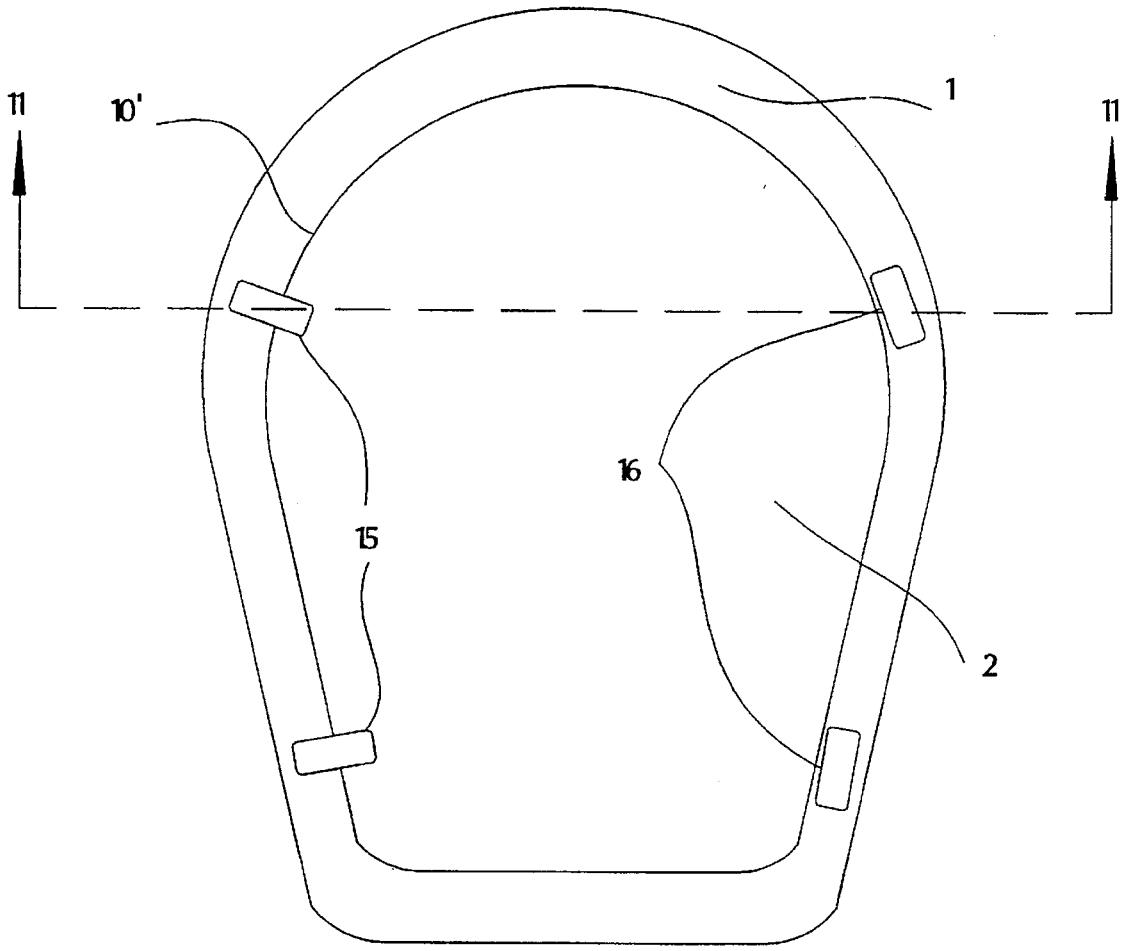
FIG. 10 is a bottom plan view showing the outer ring and insert using pivoting knobs as an alternate means of attachment.
Figure 11:
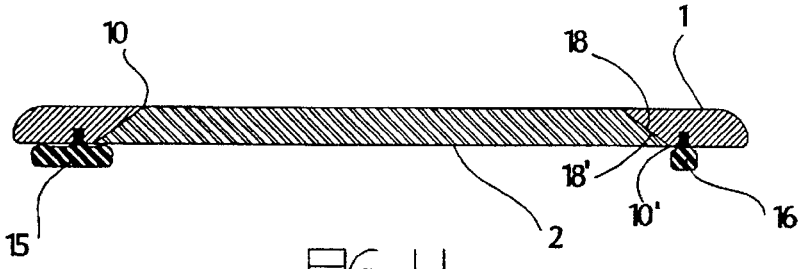
FIG. 11 is a cross sectional view of the outer ring, insert and pivoting knobs of FIG. 10.
Figure 12:
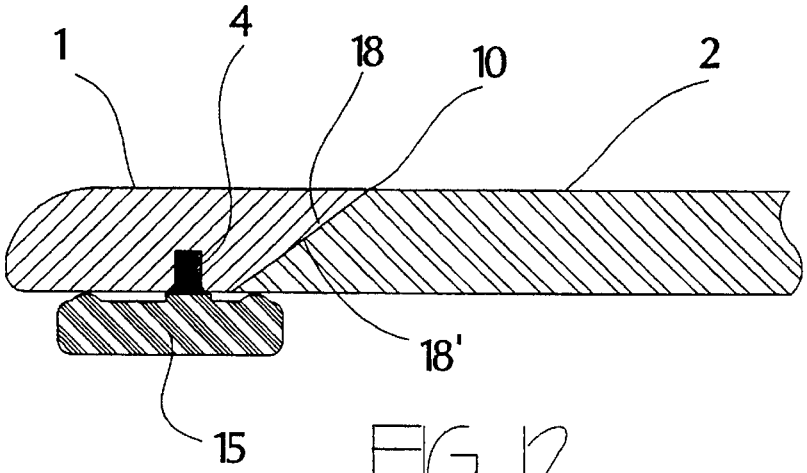
FIG. 12 is an enlarged cross sectional view showing the outer ring, insert and pivoting knobs of FIG. 10 in the assembled position.
Figure 13:
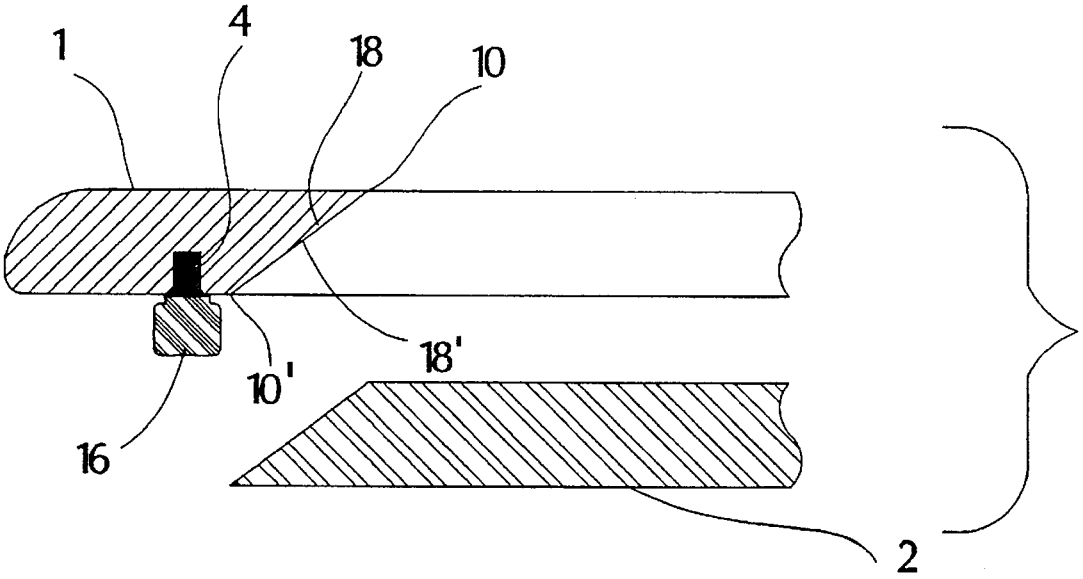
FIG. 13 is an enlarged cross sectional view showing the outer ring, insert and pivoting knobs of FIG. 10 in the disassembled position.

In yet another embodiment, shown in FIGS. 10 and 11, the attachment means is at least one, but preferably several, knobs 15 permanently mounted to the annulus 1. This knob 15 is of a pivoting design which performs two functions. First, the shape and size of knob 15 allow it to serve as a spacer of the type commonly found on toilet lids. Second, the knob 15 is used to hold the insert 2 in a detachably mounted position on the annulus 1. By rotating the knob 15, best shown as element 16 in FIGS. 10 and 11, the insert 2 may be easily removed from the annulus 1. In this embodiment, the radiused surfaces 11 and 11' and flange 5 shown in FIGS. 6, 7 and 8 have been replaced with the matably fitted bevelled surfaces 18 on the annulus 1 and 18' on the insert 2 shown in FIGS. 10 and 11. FIG. 12 is a partial cutaway view showing enlarged cross sectional detail of the attachment means in this embodiment in the assembled position. FIG. 13 is a partial cutaway view showing enlarged cross sectional detail of the attachment means in this embodiment in the disassembled position.

Figure 14:
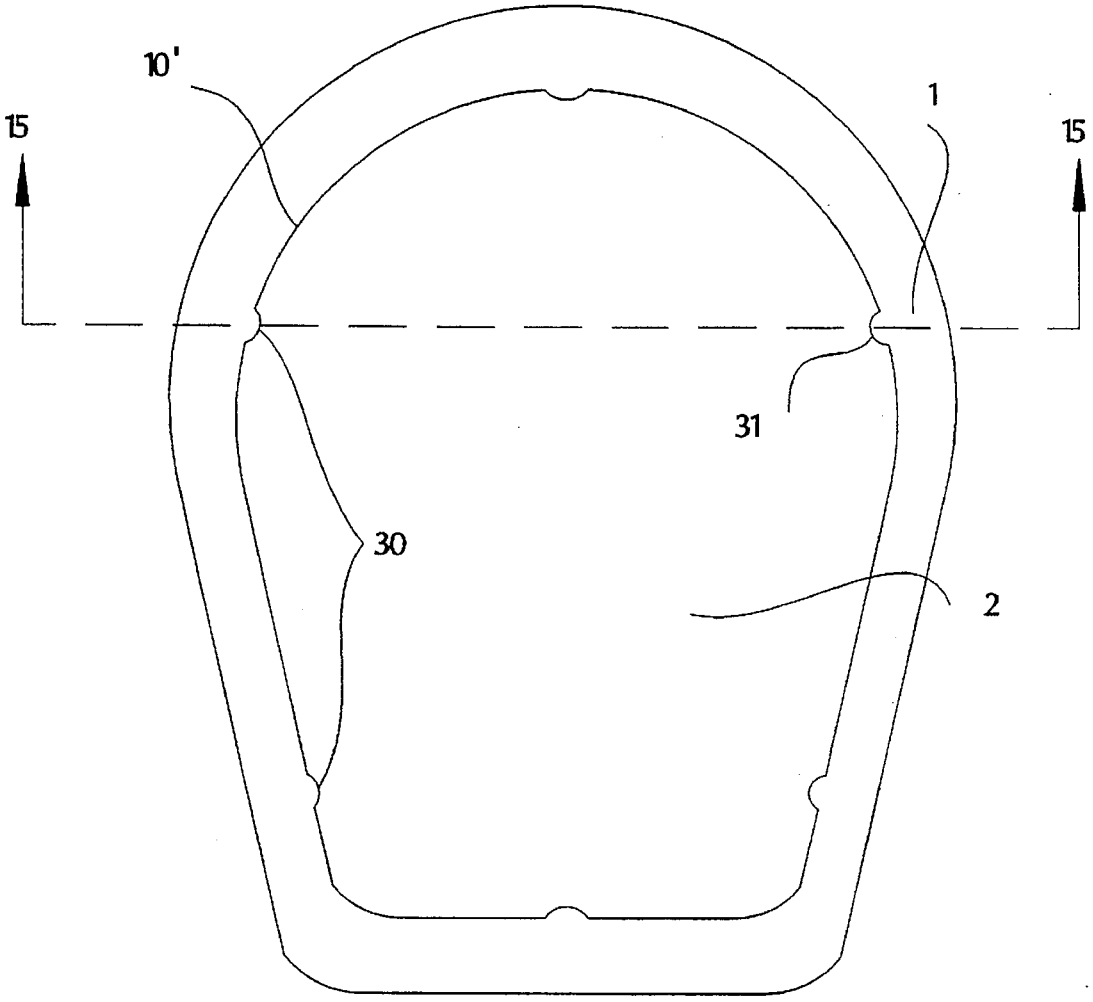
FIG. 14 is a bottom plan view showing the outer ring and insert using tabs and detents as an alternate means of attachment.
Figure 15:
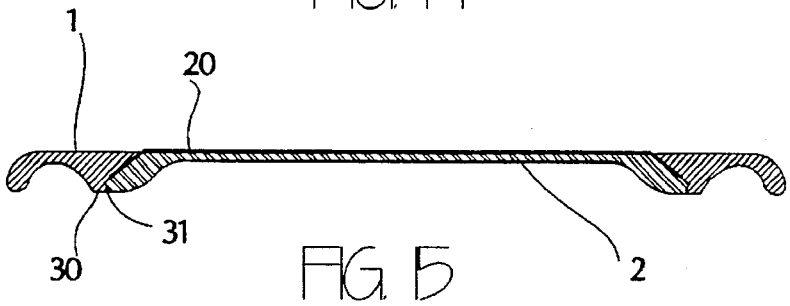
FIG. 15 is a cross sectional view of the outer ring, insert, tabs and detents of FIG. 14 illustrating a thinner cross section.
Figure 16:
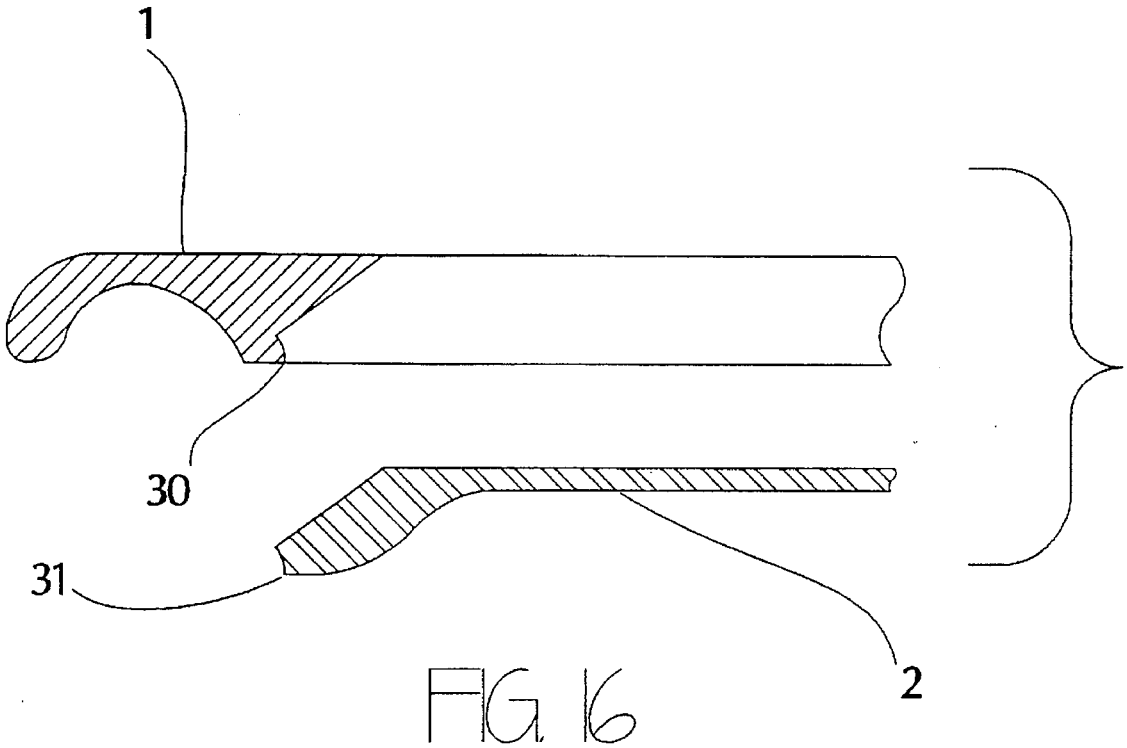
FIG. 16 is an enlarged cross sectional view showing the outer ring, insert, tabs and detents of FIG. 14 in the disassembled position.
Figure 17:
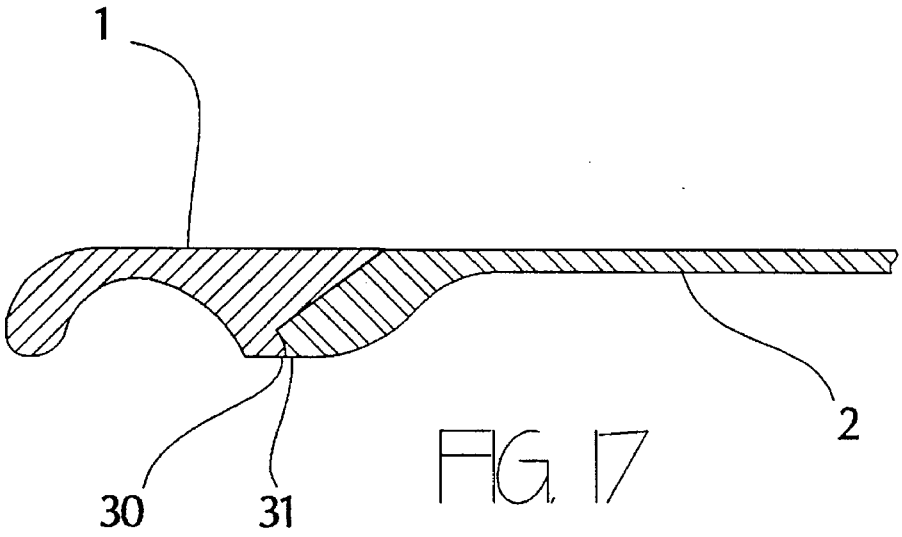
FIG. 17 is an enlarged cross sectional view showing the outer ring, insert, tabs and detents of FIG. 14 in the assembled position.
Figure 18:
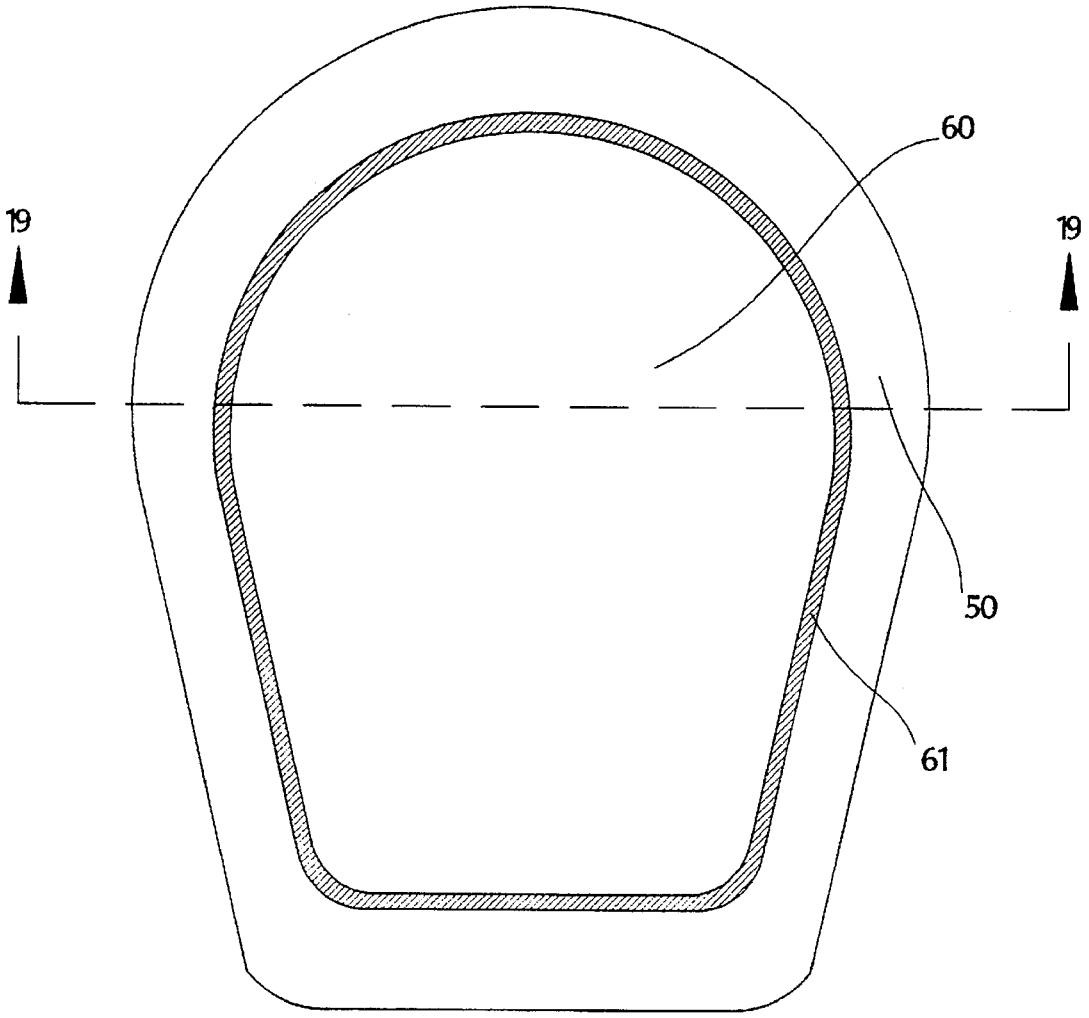
FIG. 18 is a top plan view showing a one piece lid with a groove formed into the top surface of the lid.

Another attachment means is shown in FIGS. 14 and 15. In this embodiment, the attachment means is at least one, but preferably several, tabs 30 located on the circumference of the bottom edge which defines the void in annulus 1, best shown in plan view in FIG. 14. A corresponding detent 31 is formed into the circumference of the bottom face 26 of the insert 2. This is best shown in the enlarged disassembled cross sectional view of FIG. 16. FIG. 17 is a partial cutaway view showing enlarged cross sectional detail of the attachment means in this embodiment in the assembled position. FIG. 15 is a cross sectional view of the annulus 1, the insert 2 and the decorative material 20 in the assembled position.

The disclosed attachment means reveal several methods for detachably mounting the insert 2 to the annulus 1, but any number of attachment means which provide secure detachable mounting of the insert 2 to the annulus 1 are possible.

In another embodiment, disclosed as FIGS. 18, 19, 20 and 21, the lid is comprised of an annulus 50 into the top face 60 of which is formed an annular groove 61 which determines a display area for a decorative material 20 on the top face 60 of the annulus 50. In this embodiment, shown in plan view as FIG. 18, the annular groove 61 roughly parallels the outside shape of the annulus 50 but it can be any shape.

Figure 19:
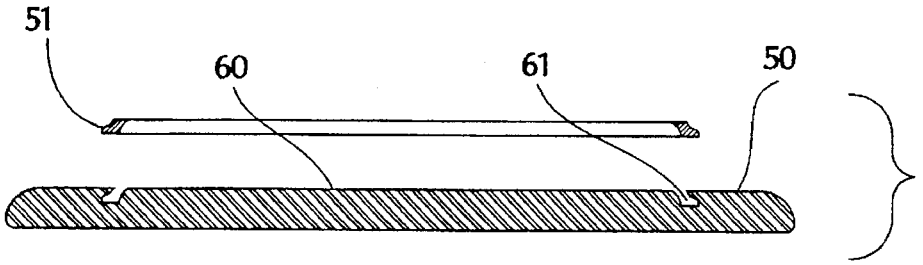
FIG. 19 is a cross sectional view of the lid of FIG. 18 showing the cross sectional shape of the groove and adding a retaining ring in the disassembled position.
Figure 20:
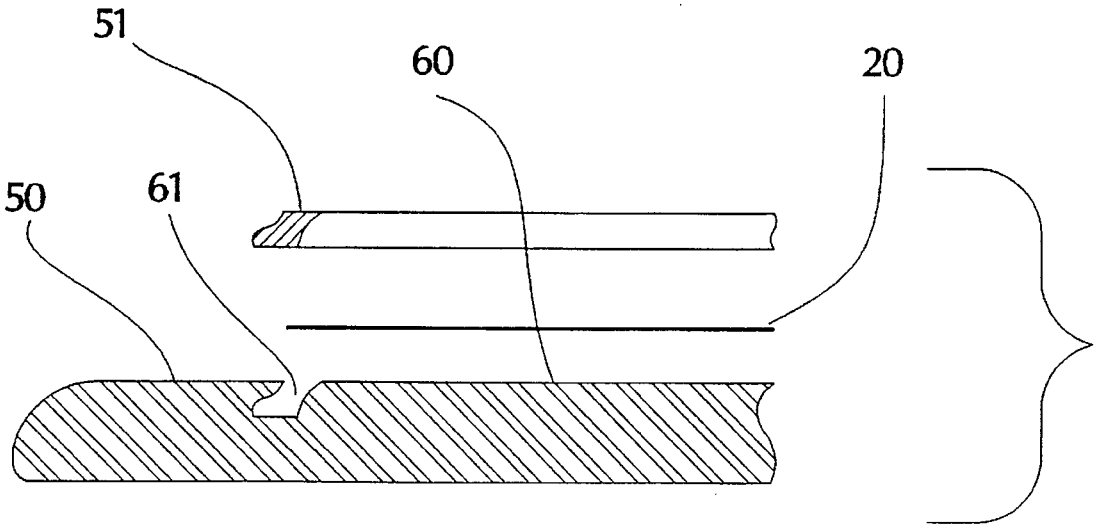
FIG. 20 is an enlarged cross sectional view of the lid of FIG. 18 showing the lid, groove, retaining ring and a decorative material in the disassembled position.
Figure 21:
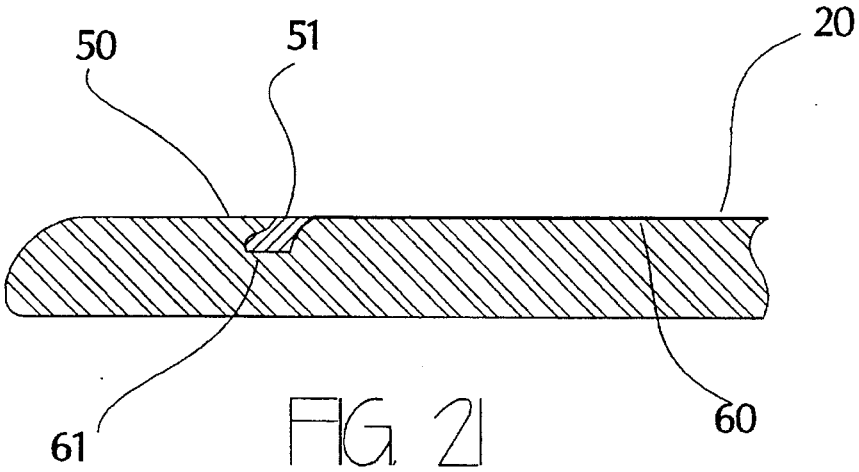
FIG. 21 is an enlarged cross sectional view of the lid of FIG. 18 showing the lid, groove, retaining ring and decorative material in the assembled position.
Figure 22:
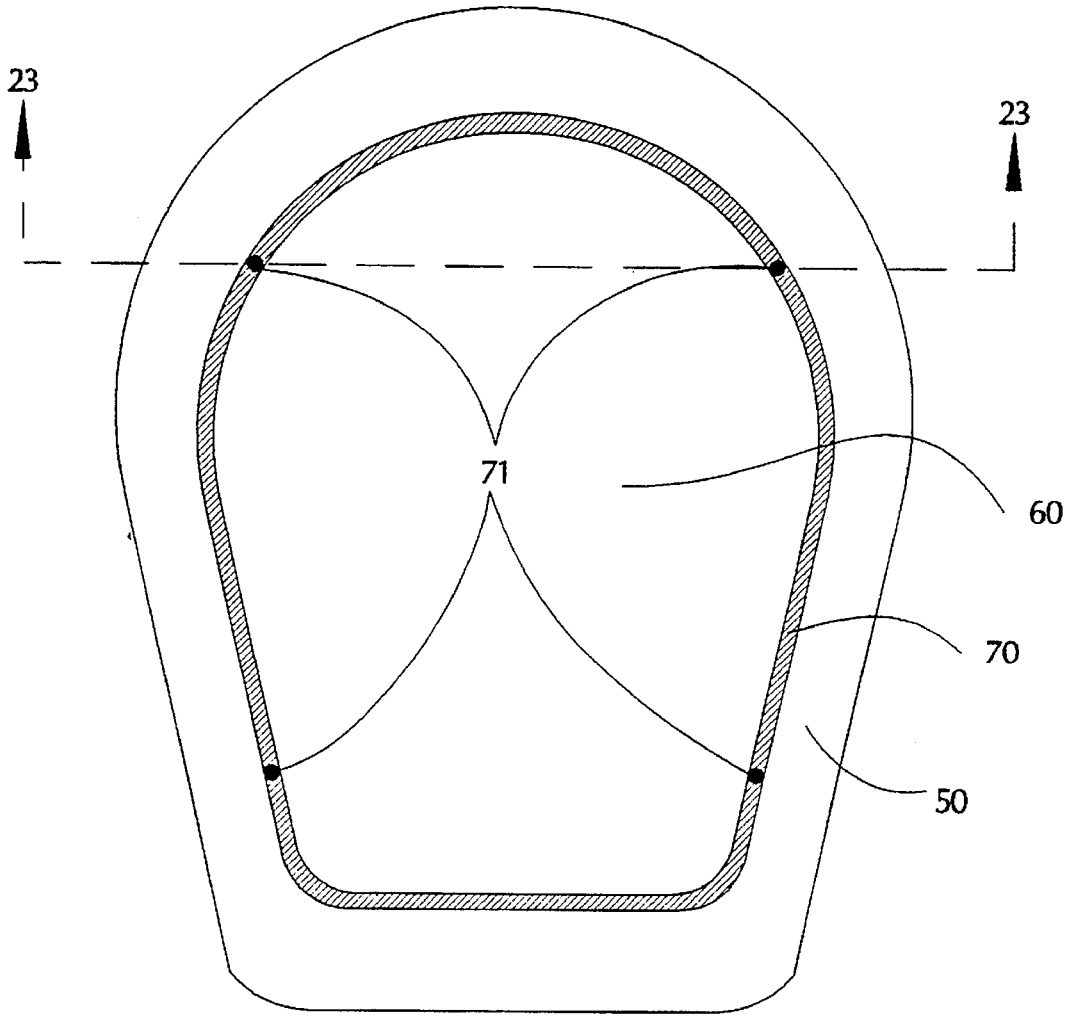
FIG. 22 is a top plan view showing a one piece lid with a groove formed into the top surface of the lid and an alternate means of attachment constructed in the groove.
Figure 23:
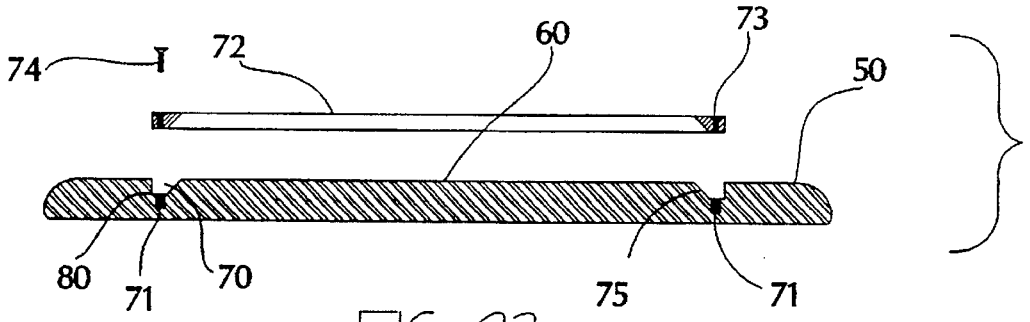
FIG. 23 is a cross sectional view of the lid of FIG. 22 showing the cross sectional shape of the groove and adding a retaining ring and a screw in the disassembled position.

As shown in FIG. 19, the cross sectional profile of the annular groove 61 may be such that it allows insertion of a retaining ring 51 to frictionally retain the decorative material 20 between the retaining ring 51 and the annular groove 61 as shown in FIG. 20. The cross sectional profile of the retaining ring 51 is predetermined by the cross sectional profile of the annular groove 61. The retaining ring 51 must made of a material such as nylon or polypropylene which is flexible enough to allow insertion of the retaining ring 51 into the annular groove 61. This flexibility will also allow the retaining ring 51 to accommodate various thicknesses of decorative material 20. FIG. 20 is a cross sectional view of the annulus 50, retaining ring 51 and the decorative material 20 in the disassembled position. FIG. 21 is a partial cutaway view showing enlarged cross sectional detail of the annulus 50, retaining ring 51 and decorative material 20 in the assembled position.

Figure 24:
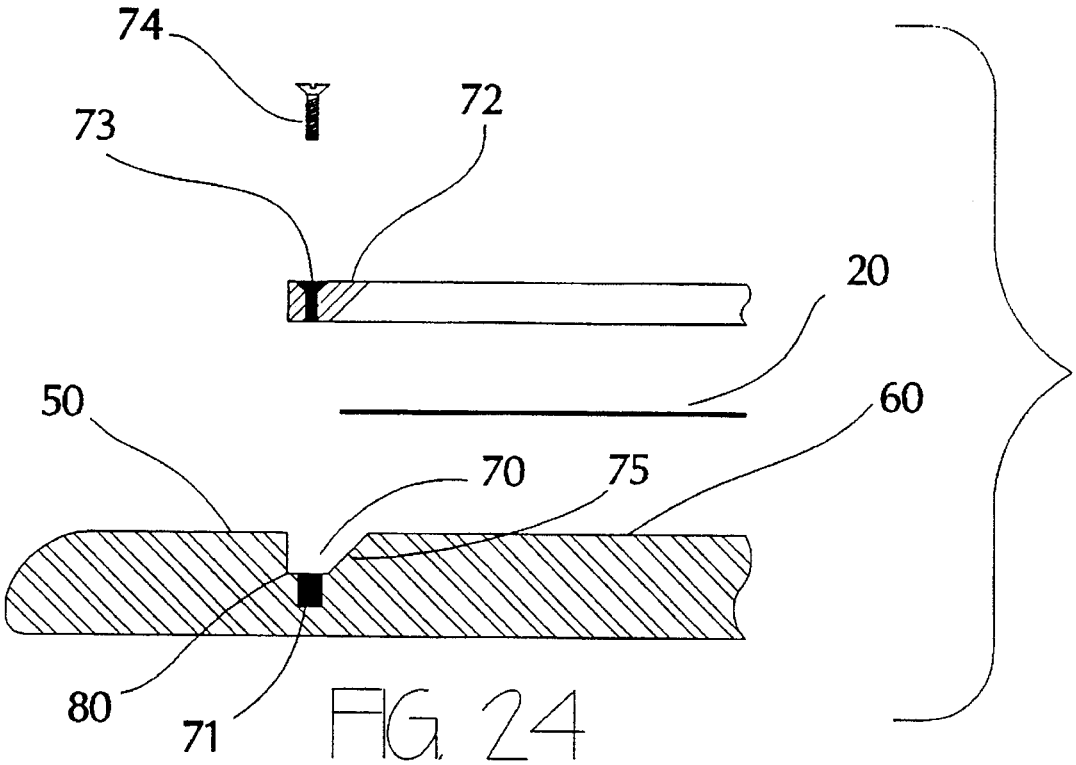
FIG. 24 is an enlarged cross sectional view of the lid of FIG. 22 showing the lid, groove, retaining ring, screw and a decorative material in the disassembled position.
Figure 25:
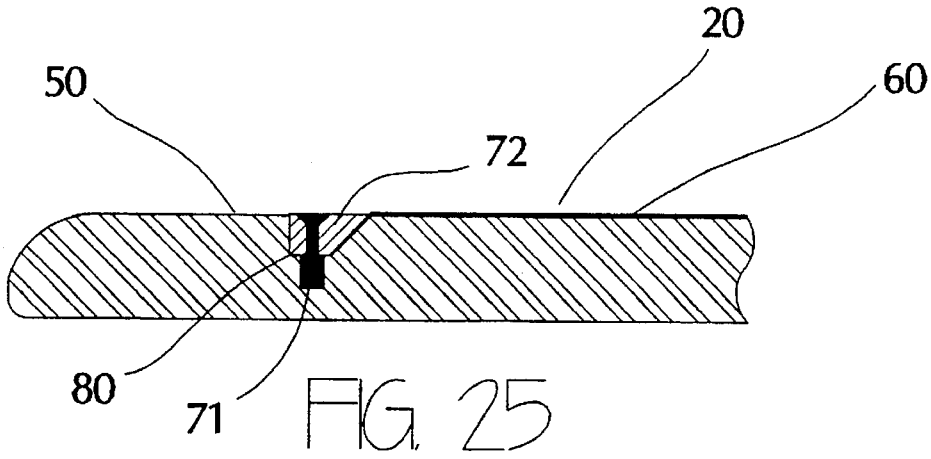
FIG. 25 is an enlarged cross sectional view of the lid of FIG. 22 showing the lid, groove, retaining ring, screw and decorative material in the assembled position.
Figure 26:
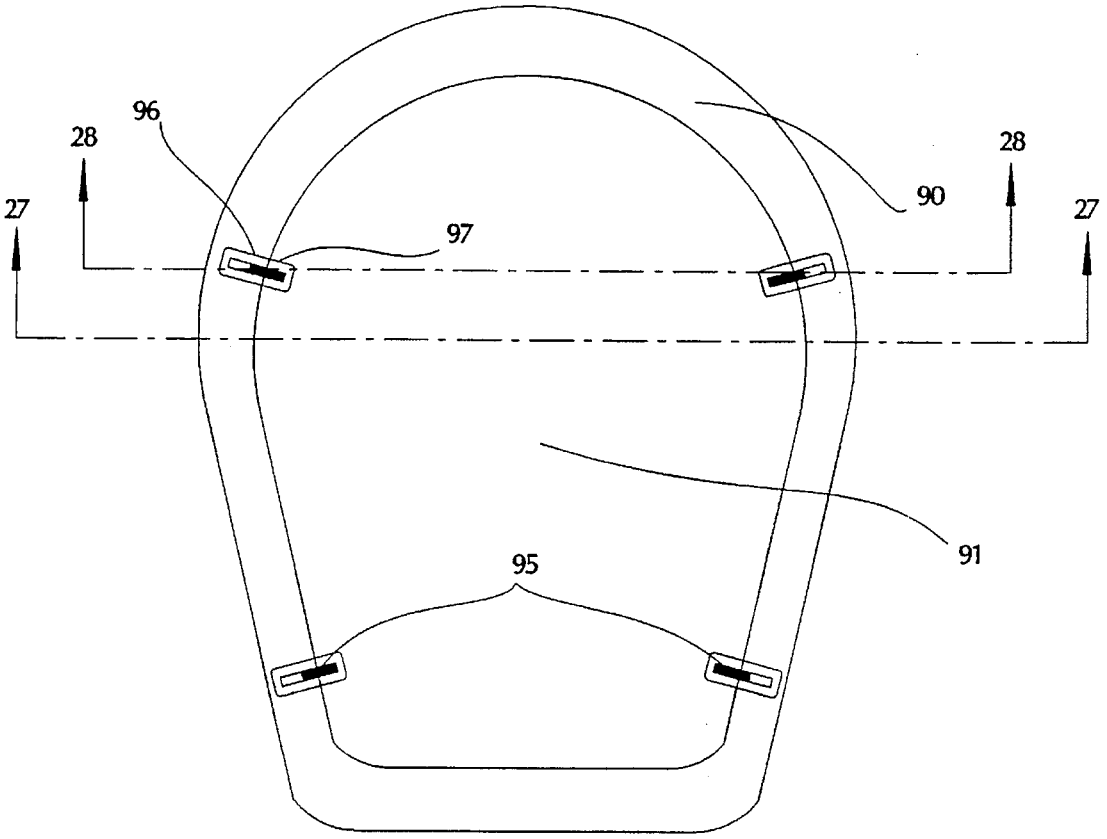
FIG. 26 is a bottom plan view showing an outer ring, insert and movable retaining pins as an alternate means of attachment.
Figure 27:
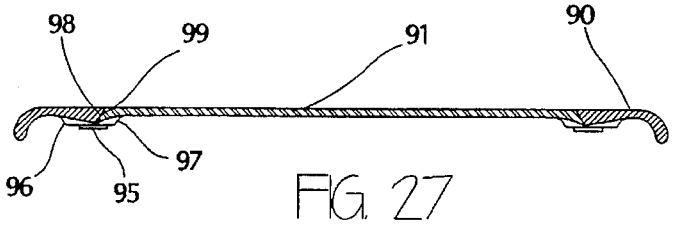
FIG. 27 is a cross sectional view of the outer ring, insert and retaining pins of FIG. 26 illustrating a thinner cross section.
Figure 28:
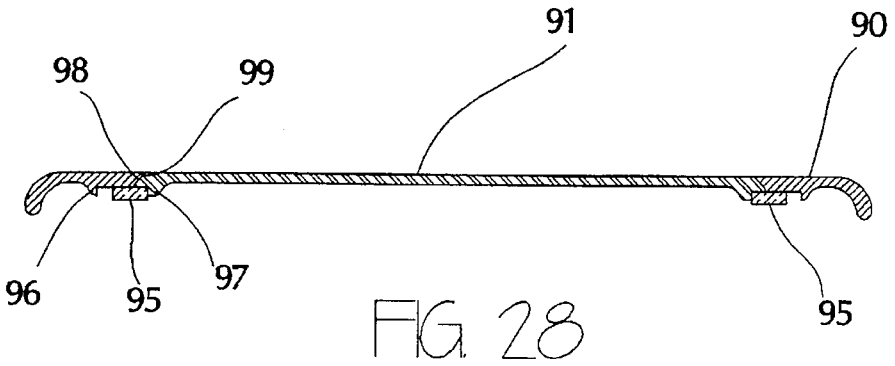
FIG. 28 is a cross sectional view of the outer ring, insert and retaining pins of FIG. 26 in the assembled position.
Figure 29:
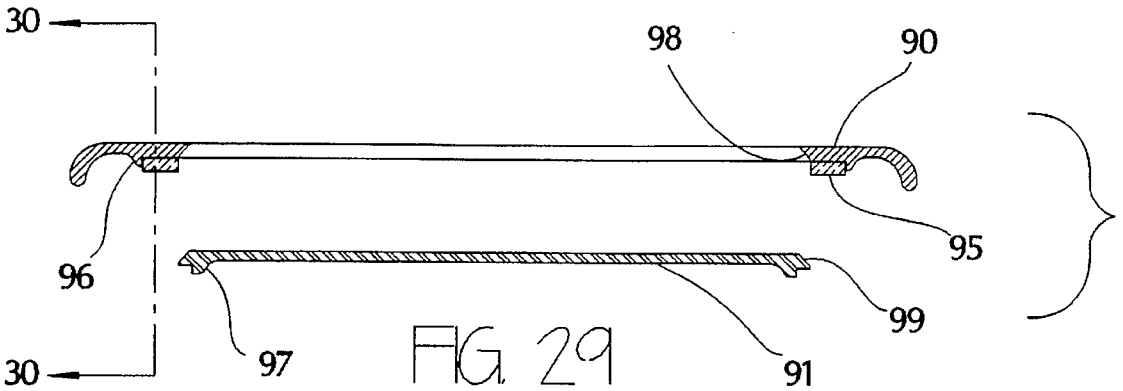
FIG. 29 is a cross sectional view of the outer ring, insert and retaining pins of FIG. 26 in the disassembled position.
Figure 30:
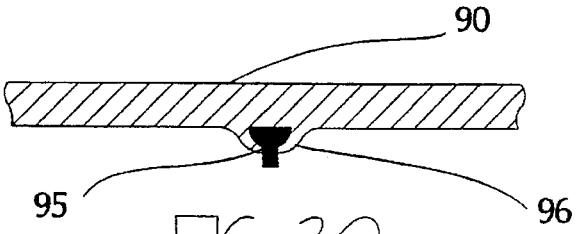
FIG. 30 is an enlarged cross sectional view of the outer ring and retaining pin of attachment of FIG. 26.

In another embodiment, disclosed as FIGS. 22, 23, 24, and 25, the annulus 50 has formed into its top face 60 an annular groove 70 which contains at least one, but preferably several, means of attachment located in the bottom surface 80 of the annular groove 70. The means of attachment as shown in FIGS. 22, 23, 24, and 25 is a threaded insert 71. The cross sectional profile of the annular groove 70 allows insertion of a matably fitted retaining ring 72 as shown in FIGS. 24 and 25. The retaining ring 72 has located about its circumference a number of holes 73 which correspond to the locations of the threaded inserts 71 in the bottom surface 80 of annular groove 70. The retaining ring 72 is detachably mounted to the annulus 50 using standard machine screws 74 inserted through the hole 73 in the retaining ring 72 and tightened into the threaded insert 71. The decorative material 20 is sandwiched between the retaining ring 72 and the bevelled face 75 of the annular groove 70, providing secure removable attachment.

All of the above described embodiments may be fabricated from any material commonly used for this type of product. The drawings generally show a thicker lid which is prevalent when the lid is made from wood.

FIGS. 26 through 30 show a thinner lid of the type commonly manufactured using some type of plastic. These drawings are provided to illustrate how the bevelled edges 98 and 99 and an attachment means 96, 96 and 97 can be incorporated into a lid of thinner cross sectional area than the previously described embodiments. In this embodiment, the annulus 90 and insert 91 are formed with a thinner cross sectional area which thickens to form the matably bevelled edges 98 on the annulus 90 and 99 on the insert 91. Additionally, at least one, but preferably several, attachment means may be formed into the annulus 90 and the insert 91. In this embodiment, these are best shown as elements 96 and 97 in FIGS. 26 through 30. A protrusion 96 formed into the bottom surface of the annulus 90 and a corresponding protrusion 97 is formed into the bottom surface of the insert 91. The cross sectional area of the protrusions 96 and 97, shown in FIG. 30, allows the matable insertion of a spacer 95. This spacer 95 serves two functions.

First, the spacer 95 may act as the type of spacer commonly found on most toilet seat and lid assemblies. The lid rests on the seat using the spacer 95 as a contact point, providing a gap between the lid and the seat.

Second, by making the spacer 95 movable in the interior cavities of protrusions 96 and 97, when fully inserted into the interior cavity of protrusion 97, the spacer 95 is equally disposed between protrusion 96 in the annulus 90 and protrusion 97 in the insert 91. This disposition of the spacer 95 serves to hold the insert 91 in a detachably mounted position on the annulus 90. The spacer 95 may alternately be disposed entirely into the protrusion 96 on the bottom surface of the annulus 90. This allows the insert 91 to be removed from the annulus 90 for insertion or replacement of the decorative material 20.

Figure 31:
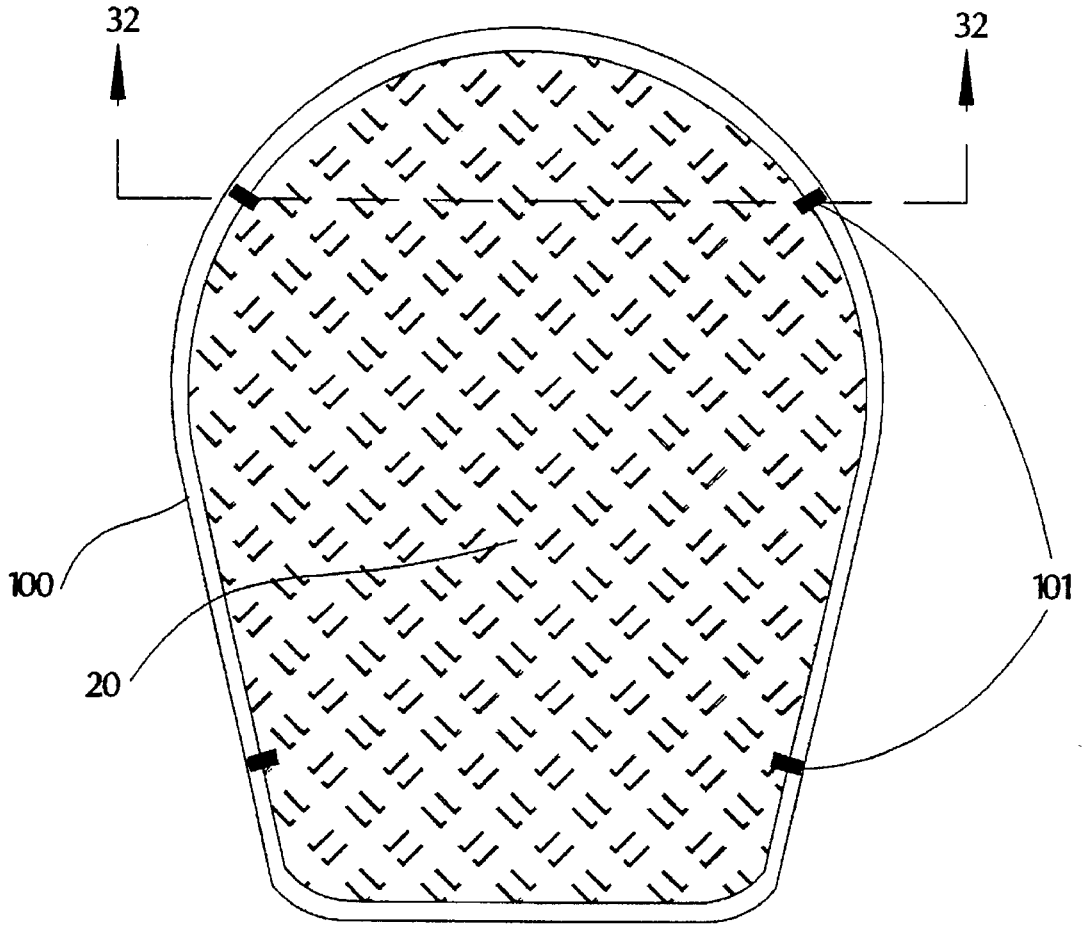
FIG. 31 is a top plan view showing the decorative material held in place on the insert using clips.
Figure 32:
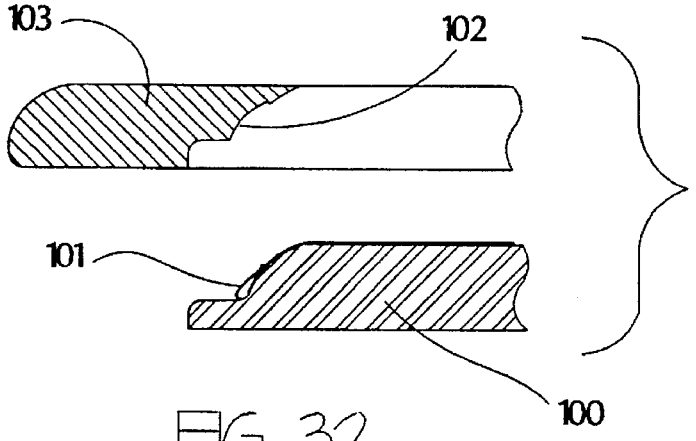
FIG. 32 is an enlarged cross sectional view of the outer ring, insert, clips and decorative material of FIG. 31.

It may be desirable to use some mechanical means to hold the decorative material 20 in place during assembly. FIG. 31 shows the decorative material 20 removably attached to the insert 100 using at least one, but preferably several, clips 101. FIG. 32 shows a corresponding cavity 102 formed into the annulus 103 to accomodate the clips 101 so that the insert 100 may be detachably mounted to the annulus 103.

The preceding descriptions are illustrative for these particular embodiments of the invention and should not be considered restrictive in any way. For example, the threaded inserts may be replaced in all cases with holes bored directly into the annulus and the machine screws then replaced with wood screws. Many other modifications are also possible within the broad scope of the invention, that scope being defined by the appended claims.

I claim:

1. A toilet seat lid comprising:

a lid member adapted for attachment to a toilet hinge of a toilet and pivotable between a horizontal position and a vertical position, said lid member having a top surface and a bottom surface, said top surface facing upwardly and said bottom surface facing downwardly when said lid is in said horizontal position;

an annular groove formed in said lid member, said annular groove extending from said top surface into an interior of said lid member, said annular groove circumscribing and defining a central area in said top surface;

a retaining member sized to removably and matingly fit into said annular groove; and, a sheet of decorative material, said sheet having a central portion and a perimeter edge for placement in said annular groove; wherein, said perimeter edge of said sheet of decorative material is sandwiched between said retaining member and said annular groove and said central portion of said sheet of decorative material overlies said central area of said top surface to thereby provide a removable and replaceable decoration for said top surface of said lid.

* * * * *